United States Patent [19]

Sung et al.

[11] Patent Number: 4,505,835

[45] Date of Patent: Mar. 19, 1985

[54] LUBRICANT OIL COMPOSITION CONTAINING A FRICTION MODIFIER

[75] Inventors: Rodney L. Sung, Fishkill; Benjamin H. Zoleski, Beacon; Sheldon Herbstman, Spring Valley; Peter Dorn, Lagrangeville, all of N.Y.

[73] Assignee: Texaco Inc., White Plains, N.Y.

[21] Appl. No.: 528,348

[22] Filed: Aug. 31, 1983

[51] Int. Cl.[3] ..... C10M 1/36

[52] U.S. Cl. ..... 252/51.5 A; 260/404.5; 260/501.11; 562/561

[58] Field of Search ..... 252/51.5 A; 260/501.11, 260/404.5; 562/561

[56] References Cited

U.S. PATENT DOCUMENTS

| | | | |
|---|---|---|---|
| 3,773,479 | 11/1973 | Dorn et al. | 44/71 |
| 4,204,841 | 5/1980 | Beasotte et al. | 44/72 |
| 4,207,079 | 6/1980 | Herbstman et al. | 260/501.11 |
| 4,433,977 | 2/1984 | Carrier et al. | 44/71 |

*Primary Examiner*—Jacqueline V. Howard
*Attorney, Agent, or Firm*—Robert A. Kulason; James F. Young; James J. O'Loughlin

[57] ABSTRACT

A lubricant composition includes a mineral lubricanting lubricant composition and a friction modifying amount of a reaction product of an amine and maleic anhydride represented by the formula:

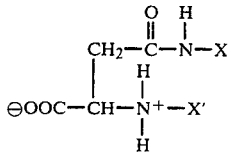

in which X and X′ are either:

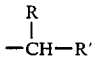

(A)

in which R and R′ can be any hydrocarbon radicals and the total number of carbon atoms in R plus R′ varies from about 6 to about 30, and wherein the nitrogen is bound to a secondary carbon atom, or wherein R is a hydrogen atom and R′ is a branched hydrocarbon radical having from about 6 to 30 carbon atoms, or

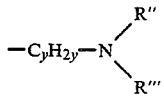

(B)

in which Y varies from 2 to 6, and in which R″ is a hydrocarbon radical having from about 6 to 30 carbon atoms, and R‴ is hydrogen or a methyl radical. The lubricant composition finds use in various internal combustion engines including slow and medium speed diesel engines and as a lubricant in the upper cylinder of a slow speed marine diesel engine.

9 Claims, No Drawings

LUBRICANT OIL COMPOSITION CONTAINING A FRICTION MODIFIER

BACKGROUND OF THE INVENTION

This invention relates to a lubricant oil composition and more particularly, to a lubricant oil composition containing a friction modifier which is a reaction product of a maleic anhydride and an amine.

With the increase in energy costs, the cost of petroleum products derived from crude oil has escalated rapidly. These costs are particularly burdensome to users of transportation fuels such as railroads and ships which consume large quantities of petroleum products.

Railroad and ship diesel engines both consume thousands of gallons of now more expensive diesel fuel each year. These fuel charges are passed along to the consumer in the form of higher shipping costs.

For example, the largest marine diesel engines used for ship propulsion are slow speed marine diesel engines. These engines are quite large with the larger units approaching 2,000 tonnes in weight and upwards of 30 meters in length and 50 meters in height. These engines can revolve at rates ranging from about 100 to 125 revolutions per minute.

The slow speed marine diesel engines are unique in their design. The crankcase of the large slow speed single acting, two stroke crosshead type of engine is completely separate from the combustion chambers of the engine. Because of this, its lubrication requirement differs from that of a typical diesel engine. In particular, the upper cylinder portion of the slow speed diesel engine which is not in direct communication with the crankcase of the engine, has its own lubrication system with lubrication requirements that are quite different from that of the crankcase lubricant. Generally, and for reasons of economy, the fuel employed in the large slow speed diesel engines are residual fuels having relatively high levels of sulfur. This generally requires the employment of highly overbased lubricating oil composition in order to counteract the acidity generated during the combustion of the sulfur containing fuel. As a result, the typical cylinder lubricating oil composition for a slow speed diesel engine will have an alkalinity level expressed as Total Base Number ranging between about 50 and 100.

The fuel consumption rate of a marine diesel engine of the size contemplated herein ranges upwards of 4500 liters of fuel per hour. One method of reducing the overall fuel consumption of such an engine, as well as other diesel engines, is in reducing frictional losses within the engine by using a lubricant composition which materially reduces such frictional losses. Reductions in engine friction result in significant fuel savings.

Numerous means have been employed to reduce the friction in internal combustion engines. These range from the use of lower viscosity lubricating oils or mixtures of mineral and synthetic lubricating oils as well as to the incorporation of friction-reducing additives such as graphite, molybdenum compounds and other chemical additives. There are limits to the extent to which the viscosity of a lubricating oil can be reduced for the purpose of reducing friction. Generally, a lubricating oil having too light a viscosity will fail to prevent metal-to-metal contact during high load operating conditions with the result that unacceptable wear will occur in the engine.

A preferred method of modifying a lubricant composition, whether for the cylinder or for the crankcase, to reduce frictional losses involves the addition of an additive which reduces the friction within the engine without adversely affecting the engine or the lubricating properties of the lubricating oil while maintaining its antifriction properties over the extended service life and operating conditions of the engine.

Coassigned U.S. Pat. No. 4,207,079, incorporated herein by reference, sets forth a primary aliphatic hydrocarbon amino alkenyl-substituted asparagine which can be used in the lubricant composition of the present invention. Further, the Patent sets forth the use of the asparagine in fuel compositions to improve the detergency of such composition.

Coassigned U.S. Pat. No. 4,204,841 sets forth the same asparagine with other additives for use in fuel oil compositions wherein the added asparagine with other additive acts as a detergent. Coassigned U.S. Pat. No. 3,905,781 and No. 3,773,479 set forth alkyl-substituted asparagines which are also used as additives in motor fuel compositions.

SUMMARY OF THE INVENTION

It has now been found that the addition of a reaction product of an amine and maleic anhydride represented by the formula:

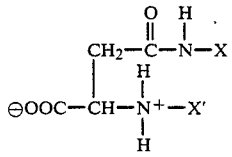

in which X and X′ are either:

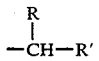

(A)

in which R and R′ can be any hydrocarbon radicals and the total number of carbon atoms in R plus R′ varies from about 6 to about 30, and wherein the nitrogen is bound to a secondary carbon atom, or wherein R is a hydrogen atom and R′ is a branched hydrocarbon radical having from about 6 to 30 carbon atoms, or

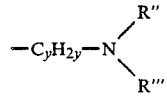

(B)

in which R″ is a hydrocarbon radical, preferably a primary aliphatic hydrocarbon radical having from about 6 to 30 carbon atoms, R‴ is hydrogen or a methyl radical, and y various from 2 to 6, to a lubricating oil produces a lubricant composition which, when used in a crankcase of an engine or the cylinder of a slow speed marine diesel engine, decreases the friction between the parts of the engine, as between the piston rings and cylinder wall, thereby increasing the fuel economy of the engine. Since railroad and marine diesel engines use large quantities of fuel per hour, even a small decrease in friction will result in a large monetary savings. Other diesel engines which use less fuel will, of course, have smaller savings. The invention also includes concentrates wherein a major component of the concentrate is the friction modifier and a minor component is a lubricating oil. The concentrate as well as the lubricant composition can also have other additives.

DESCRIPTION OF THE PREFERRED EMBODIMENTS

A preferred compound useful in the invention is the reaction product above in which X is $$C_yH_{2y}-\overset{\overset{\displaystyle R''}{|}}{N}-R''',$$

in which y can be a number between 2 and 6, and wherein R'' is a straight chain primary aliphatic hydrocarbon radical and R''' is hydrogen. A particularly preferred compound is one formed from a straight chain aliphatic hydrocarbon radical having from 16 to 20 carbon atoms and 1,3-propane diamine. This compound is represented by the formula:

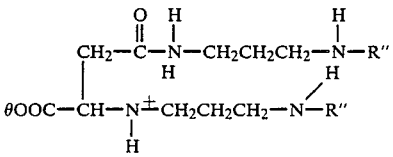

in which R is a primary aliphatic hydrocarbon radical having from 16 to 20 carbon atoms.

The friction modifier can be prepared by reacting an N-primary alkyl alkylene diamine with maleic anhydride. Approximately two moles of amine are reacted with one mole of maleic anhydride at a temperature ranging from about room temperature to about 110° C. maximum, preferably from about 60° C. to 100° C. The upper temperature limit in the preparation of the additive is critical. Higher temperatures especially above 110° C. cause the formation of succinimide compounds.

The N-primary alkyl-alkylene diamine reactant is represented by the formula:

$$R'',R'''N-C_yH_{2y}NH_2$$

in which y varies from 2 to 6 and R'' is a primary aliphatic hydrocarbon radical having from about 6 to 30 carbon atoms and R''' is hydrogen or a methyl radical. Preferred N-primary alkyl-alkylene diamines are those in which R''' is a straight chain primary alkyl radical and R' is hydrogen. As employed herein the term N-alkyl-alkylene diamine covers both N-monoalkylalkylene diamine and the N-dialkyl-alkylene diamine structure when R''' is a methyl radical.

The most preferred N-alkyl-alkylene diamines are represented by the formula:

$$R''-NH-CH_2-CH_2-CH_2-NH_2$$

in which R'' is a straight chain primary alkyl aliphatic hydrocarbon radical having from 16 to 20 carbon atoms.

Examples of suitable N-alkyl-alkylene diamines include N-soya-1,3-propane diamine, N-coco-1,3-propane diamine, N-tallow-1,3-propane diamine, N-oleyl-1,3-propane diamine, N-decyl-1,3-propane diamine, N-lauryl-1,3-propane diamine, N-octyl-1,3-propane diamine, N-stearyl-1,3-propane diamine, N-behenyl-1,3-propane diamine, and N-tetradecyl-1,3-propane diamine. These on reaction, yield the following:

N,N'-di-(3-n-soyaamino-1 propyl)asparagine,
N,N'-di-(3-n-tallowamino-1-propyl)asparagine,
N,N'-di-(3-n-cocoamino-1-propyl)asparagine
N,N'-di-(3-n-oleylamino-1-propyl)asparagine,
N,N'-di-(3-n-decylamino-1-propyl)asparagine,
N,N'-di-(3-octylamino-1-propyl)asparagine,
N,N'-di-(3-stearylamino-1-propyl)asparagine,
N,N'-di-(3-tetradecylamino-1-propyl)asparagine,
N,N'-di-(3-laurylamino-1-propyl)asparagine,
N,N'-di-(3-behenylamino-1-propyl)asparagine.

The reaction is illustrated by the following formulas:

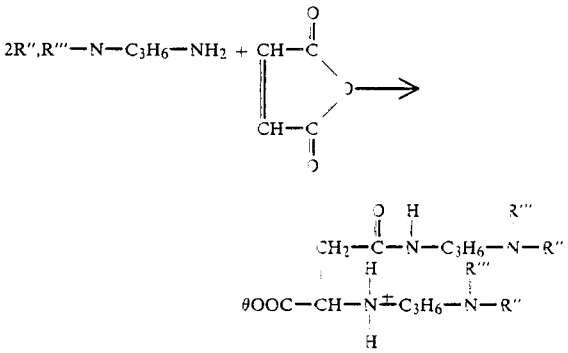

in which R'' and R''' have the value noted above.

The friction modifier can also be prepared by reacting a secondary alkyl primary amine with maleic anhydride. Approximately 2 moles of amine are reacted with one mole of maleic anhydride at a temperature ranging from about room temperature to about 110° C. maximum, preferably from about 60° C. to 100° C. The upper temperature limit in the preparation of the additive is critical. Higher temperatures, especially above 110° C., cause the formation of succinimide compounds.

The secondary alkyl primary amine reactant is represented by the formula:

$$H_2N-\overset{\overset{\displaystyle R}{|}}{C}H-R'$$

in which R and R' can be any hydrocarbon radicals such as aliphatic, branched, cyclic, aryl, unsaturated radicals and combinations of these, wherein the total number of carbon atoms in R plus R' is between about 6 and 30.

In another preferred embodiment, R is a hydrogen atom and R' is any branched hydrocarbon radical having from about 6 to about 30 carbon atoms. The branched R' group permits the reaction product to which it is attached to be soluble in the lubricant composition. Generally, the minimum branching is a single tertiary butyl group or three methyl groups. Further branching is beneficial, since the resulting compound will be more soluble in the lubricant composition.

A particularly preferred embodiment of this compound is wherein R and R' are straight chained primary aliphatic hydrocarbon radicals having a total of between about 10 and 30 carbon atoms, preferably 15 to 20 carbon atoms and whose structure can be represented by the formula:

$$CH_3[C_zH_{2z-1}]CH_3(NH_2)$$

wherein z is a number from 8 to 28, preferably 13 to 18 and the nitrogen is attached to anyone of the secondary carbon atoms. The reaction is illustrated by the following formulas:

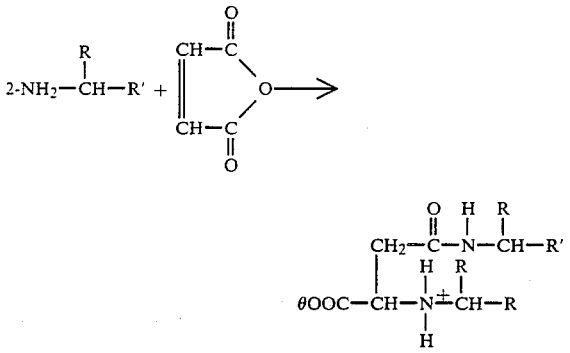

and

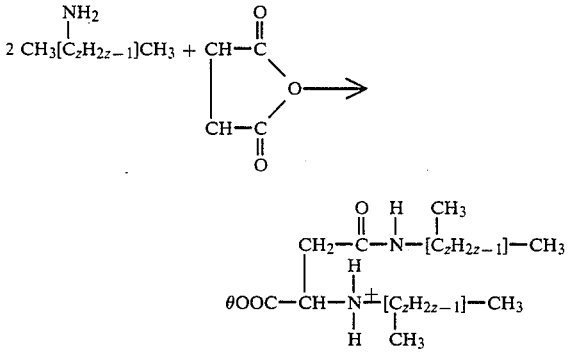

Examples of suitable secondary alkyl primary amines include $C_{14}$–$C_{15}$ secondary alkyl primary amine; $C_{10}$–$C_{14}$ secondary alkyl, primary amine; $C_{15}$–$C_{20}$ secondary alkyl, primary amine; $C_7$–$C_9$ secondary alkyl primary amine; secondary octyl, primary amine; secondary decyl, primary amine; secondary nonyl, primary amine; secondary octa decyl, primary amine; $C_{12}$ tert. alkyl, primary amine; $C_{18}$ tert. alkyl primary amine; $C_{12}$–$C_{14}$ tert. alkyl primary amine; $C_{18}$–$C_{22}$ tert. alkyl primary amine; and $C_{11}$–$C_{14}$ secondary alkyl primary amine. Preferred amines include:

3-amino-2-methyl heptadecane;
3-amino-2-methyl undecane;
2-amino heptane, 2-amino-octane;
2-amino-nonane;
2-amino dodecane, 2-amino-tridecane;
2-aminotetradecane;
2-amino pentadecane;
a mixture of 2-aminopentadecane through 2-amino-eicosane, and 6-amino pentadecane through 6-amino hemeicosane.

The most preferred secondary alkyl primary amines are those having a n-paraffin, for example Armeen L-15, backbone.

Examples of specific compounds of the invention produced in the above reactions include the following:

N,N'-di-$C_{14}$–$C_{15}$ secondary alkyl asparagine
N,N'-di-$C_{10}$–$C_{14}$ secondary alkyl asparagine
N,N'di-$C_{15}$–$C_{20}$ secondary alkyl asparagine
N,N'di-$C_7$–$C_9$ secondary alkyl asparagine
N,N'di-$C_{11}$–$C_{14}$ secondary alkyl asparagine
N,N'di-$C_{12}$-tertiary alkyl asparagine
N,N'di-$C_{18}$ tertiary alkyl asparagine.

(In the above amines R' is a mixture of secondary alkyl groups having the indicated range of carbon atoms.)

N-$C_{12}$–$C_{14}$ tertiary alkyl-N'-$C_{18}$–$C_{22}$ tertiary alkyl asparagine
N-sec.-Noctyl, N'-sec. decyl asparagine
N-sec-onyl, N'-sec.-octadecyl asparagine In the above amines the two R' groups are not the same but are different alkyl groups. Such asparagines can be formed by using two different secondary alkyl primary amines. Asparagines formed by using a single amine, or a mixture of amines and thus having two of the same substituents, two different substituents or mixtures of these are useful in the invention.

It will be appreciated that by-products and/or impurities can be co-produced along with the compound in this reaction. The desired additive compounds can be readily recovered from the reaction product by known methods. However, it is feasible and economical to employ the prescribed compounds as produced without separation or purification.

The friction modifying component of the lubricant composition of the invention is effective in a range from about 0.2 to 5 weight percent based on the total lubricant composition. In general, it is preferred to employ from about 0.5 to 2 weight percent of the friction modifier with the most preferred concentration ranging from about 0.75 to 1.5 weight percent.

Another component of the lubricant composition of the invention can be an overbased calcium sulfonate, preferably having a Total Base Number ranging from 300 to 450 on an active material or neat basis. This component is preferably employed in a finished lubricant such as a lubricant for the upper cylinder of a slow speed marine diesel at a concentration ranging from above 10 to 20 weight percent based on the weight of the lubricant composition and sufficient to provide a lubricant having a Total Base Number from about 50 to 100. A preferred overbased calcium sulfonate has a TBN ranging from about 350 to 425, a preferred concentration of the sulfonate in the lubricant composition is from about 12 to 18 weight percent and a preferred TBN for the lubricant composition from 60 to 80. Total Base Number (TBN) is a measure of alkalinity determined according to the test procedure outlined in ASTM D-664.

Overbased calcium sulfonates can be derived from sulfonic acids or particularly from petroleum sulfonic acids or alkylated benzene sulfonic acids. Useful sulfonic acids from which the overbased calcium sulfonates are prepared can have from about 12 to 200 carbon atoms per molecule. Examples of specific sulfonic acids include mahogany sulfonic acid, petroleum sulfonic acids, aliphatic sulfonic acids and cycloaliphatic sulfonic acids. Particularly useful alkylated benzene sulfonic acids include polybutenylbenzene sulfonic acid, polypropylbenzene sulfonic acid and copolymer propyl 1-butylbenzene sulfonic acids having molecular weights ranging from about 400 to about 900.

The overbased calcium sulfonates are produced by neutralizing the sulfonic acid with a calcium base to form a calcium sulfonate salt and then overbasing the calcium sulfonate with calcium carbonate generally by passing carbon dioxide through a mixture of the neutral calcium sulfonate, mineral oil, lime and water. Methods for preparing overbased calcium sulfonates are disclosed in U.S. Pat. No. 3,799,920 and U.S. Pat. No. 4,131,551 and the disclosures in these references are incorporated herein by reference.

Overbased calcium sulfonates are components of many lubricant compositions since they act to neutralize acids generated during the composition of sulfur-containing fuels in the engine. The presence of acids in the oil can act to corrode various portions of the engine, thus reducing its service life. Acid producing components of the fuel include among others, sulfur-containing compositions in the fuel. In engines employing high sulfur-residual fuels, such as the large, slow speed marine diesel engines, large quantities of acids are generated from the high sulfur content which acids must be neutralized.

Slow speed marine diesel engines are unique in the design since the crankcase of the engine is completely separate from the combustion chamber. Because of this, the upper cylinder portion of the slow speed marine diesel engine, which is not in direct communication with the crankcase of the engine, has its own lubrication system. Since this portion of the engine is in contact with the acid products of combustion, a cylinder lubricant will have a much higher total base number than one used with other engines or used in the crankcases of slow speed marines diesel engines which by not being in direct communication with the combustion chamber require a much lower total base number containing lubricant. Thus a lubricant which is injected into the upper cylinder zone of a slow speed diesel engine employing a high sulfur residual fuel oil will have a high total base number as set forth above and by including the friction modifier set forth herein also reduces the friction within the engine thereby increasing the efficiency of the engine.

The hydrocarbon base oil which can be employed to prepare the lubricant composition of the invention includes naphthenic base, paraffinic base and mixed base oils, lubricant derived from coal products and synthetic oils, e.g., alkylene polymers such as polypropylene and polyisobutylene of a molecular weight of between about 250 and 2500. Advantageously, a lubricating base oil having a lubricant viscosity SUS at 100° F. of between about 50 and 1500, preferably between about 100 and 1200, are normally employed for the lubricant composition. The most preferred lubricating viscosity for a cylinder lubricant composition is a viscosity ranging from about 68 to 108 SUS at 210° F. The hydrocarbon oil will generally constitute from about 80 to 90 weight percent of the total lubricant composition with the preferred concentration range being from about 82 to about 88 weight percent. The amount of the hydrocarbon oil will of course be much smaller when used as part of a concentrate which is later added to a hydrocarbon oil to form a lubricant composition.

The lubricant composition especially when used in a crankcase, can also contain at least one additive selected from the group consisting of an overbased calcium sulfonate as set forth in the preceding paragraphs, an anti-wear agent, an oxidation inhibitor, a detergent, a rust inhibitor, a dispersant, an antifoamant, and a corrosion inhibitor. The quantity of these various additives necessary in the oil mixture will be apparent to one skilled in the art. Their concentration will of course be higher in a concentrate which is subsequently added to a hydrocarbon oil to form a finished lubricant composition.

The improvement in fuel economy brought about by the novel lubricant composition of the invention was demonstrated in the Small Engine Friction Test. The Small Engine Friction Test (SEFT) uses a single cylinder, air-cooled, 6-horsepower engine driven by an electric motor. The engine has a cast-iron block and is fitted with an aluminum piston and chrome-plated rings. The electric motor is cradle-mounted so that the reaction torque can be measured by a strain arm. The engine is housed in a thermally insulated enclosure with an electric heater and is driven at 2000 rpm.

Prior to each test, the engine is flushed three times with 1-quart charges of test oil. During the test run, the engine and oil temperatures are increased continually from ambient until a 280° F. (138° C.) oil temperature is reached. The heat comes from engine friction, air compression work and from the electric heater. The engine and oil temperatures and the engine motoring torque are recorded continually during the test. A SEFT run takes about 4 hours. Each test oil evaluation is preceded by a run on a reference oil for a like period of time. The torque reference level for the engine shifts very slowly with time as a result of engine wear. Therefore, the test oil results were recorded compared to a reference band consisting of data from up to three reference runs made before and three runs made after the test oil evaluation.

The friction modifying effects of the novel lubricant composition of the invention were evaluated in several lubricant compositions including slow and medium diesel engine lubricating oils and a marine cylinder lubricant composition. Both the lubricant compositions without and with the friction modifier were tested for friction properties in the Small Engine Friction Test described above.

The method of making the friction modifier and the composition of the lubricants to which it was added and the results of the Small Engine Frictions Tests are set forth in the following examples which are not meant to limit but only to illustrate the invention.

EXAMPLE I 63.4 grams of maleic anhydride (0.647 mole) were suspended in 423.4 grams mineral oil having an SUS at 100° F. of 100, and with stirring and nitrogen purge was heated at 100° C. for 1 hour. N-oleyl-1,3-propane diamine (Duomeen-O, 460 grams, 1.347 mole) in 100 grams of mineral oil similar to the above was introduced at 100° C. over 1 hour. The reactant was heated at 100° C. an additional 2 hours and then filtered hot.

Analysis of the 50 percent oil solution of the additive was as follows:

| | |
|---|---|
| N, wt. % | 3.5 |
| Total Acid Number | 27.4 |
| Total Base Number | 106.5 |

The friction modifier made as in the above paragraph was added to a commercial marine cylinder lubricant composition, whose composition is set forth in Table I.

TABLE I

| Composition | Vol. % |
|---|---|
| Solvent Neutral Oil | 38.338 |

TABLE I-continued

| Composition | Vol. % |
|---|---|
| SUS at 100° F. of 845 | |
| Bright Stock 145, 135-145 SUS at 212° F. | 16.300 |
| 75/80 Pale Oil 70-77 SUS at 212° F. | 31.550 |
| Overbased Calcium Sulfonate 400 TBN | 13.800 |
| Corrosion Inhibitor | 0.012 |
| Silicone Antifoamant in PPM | 150 |

The Small Engine Friction Test motoring torque, in foot pounds at 280° F. was 3.20 for the lubricant composition as set forth in Table I. When one volume percent of the friction modifier as made in the first paragraph of Example I was added to the lubricant composition, the Small Engine Friction Test motoring torque, in foot pounds at 280° F. dropped to 2.78 which was an improvement of 13.1 percent. Such a large reduction in friction would result in a considerable savings in usage of fuel.

EXAMPLE II

A slow medium speed lubricant composition which can be used in the crankcase of a slow speed marine diesel engine and whose composition is set forth in Table II was made.

TABLE 2

| Composition | Vol. % |
|---|---|
| Solvent Neutral Oil SUS at 100° F. of 230 | 24.02 |
| Solvent Neutral Oil SUS at 100° F. of 845 | 71.60 |
| Antiwear Additive | 0.48 |
| Oxidation Inhibitor | 0.30 |
| Detergent | 3.30 |
| Rust Inhibitor | 0.30 |
| Silicone Antifoamant in PPM | 150 |

The Small Engine Friction Test motoring torque, in foot pounds at 280° F. for the lubricant composition of Table II was 2.84. When one volume percent of the friction modifier as made in Example I was added to the above lubricant composition, the Small Engine Friction Test motoring torque, in foot pounds at 280° F. was 2.73, a frictional improvement of 3.9 percent. It can be seen that the use of the friction modifier in a lubricant composition formulated for slow speed diesel engines also results in a drop in friction.

EXAMPLE III

A medium speed oil, which can be used in various medium speed diesel engines and whose composition is set forth in Table III below was made.

TABLE III

| Composition | Vol. % |
|---|---|
| Solvent Neutral Oil SUS at 100° F. of 325-350 | 10.00 |
| Solvent Neutral Oil SUS at 100° F. of 845 | 33.73 |
| 75/80 Pale Oil 70-77 SUS at 212° F. | 43.00 |
| Antiwear Additive | 0.84 |
| Dispersant | 3.92 |
| Metallic Ester Dispersant | 2.03 |
| Overbased Calcium Sulfonate 400 TBN | 1.83 |
| Overbased Calcium Phenolate | 4.53 |

TABLE III-continued

| Composition | Vol. % |
|---|---|
| Silicone Antifoamant ppm | 150 |

The Small Engine Friction Test motoring torque, in foot pounds at 280° F. for this oil was 2.82. When one volume percent of the friction modifier as made in Example I was added, the engine torque, in foot pounds at 280° F. dropped to 2.38. This was a 15.6 percent frictional improvement. Such a large frictional improvement shows that the friction within the engine can be dramatically reduced with the use of a lubricant composition containing the friction modifier of the present invention.

EXAMPLE IV

A mixture of 508 grams of Armeen L-15, 98 grams of maleic anhydride and 516 grams of 100 E Pale Oil are heated with gentle stirring at about 80° C. for twelve hours. The mixture was filtered and the residue contains about 5.4% active species and 46% diluent. Analysis was as follows:

| | |
|---|---|
| N, wt. % | 2.0% |
| Total Acid No. | 41.6 |
| Total Base No. | 41.9 |

The friction modifier made as above was added to a commercial marine cylinder lubricant composition, whose composition is set forth in Table I.

The Small Engine Friction Test Motoring Torque, in foot pounds at 280° F. was 3.20 for the lubricant composition as set forth in Table I. When the volume percent of the friction modifier as made in the first paragraph of this example was added to the lubricant composition, the Small Engine Friction Test motoring torque, in foot pounds at 280° F. dropped to 2.89 which was an improvement of 9.7%. Such a large reduction in friction would result in a considerable savings in useage of fuel.

From the above examples it can be seen that the friction modifier of the present invention can be used in various lubricant compositions whether for the cylinders of low speed marine diesel engines or in the crankcases of slow or medium speed diesel engines.

The above examples are only illustrative, changes and modifications thereto are within the scope of the present invention which is set forth in the following claims.

What is claimed is:

1. A cylinder lubricant composition comprising a mineral lubricant and a friction modifying amount of a reaction product between an amine and maleic anhydride represented by the formula:

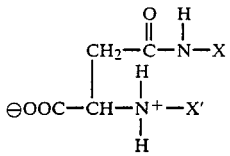

in which X and X′ are either:

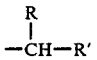

(A)

in which R and R′ can be primary aliphatic radicals and the total number of carbon atoms in R plus R′ varies from about 10 to about 30, and wherein the nitrogen is bound to a secondary carbon atom, or wherein R is a hydrogen atom and R′ is a branched hydrocarbon radical having from about 10 to 30 carbon atoms, or

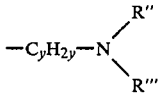

(B)

in which R″ is a hydrocarbon radical having from about 6 to about 30 carbon atoms, R‴ is hydrogen or a methyl radical and y varies from 2 to 6.

2. The lubricant composition of claim 1 wherein R and R′ are primary aliphatic hydrocarbon radicals having a total of between 10 and 30 carbon atoms.

3. The lubricant composition of claim 1 wherein R and R′ have a total of between 15 and 20 carbon atoms.

4. The lubricant composition of claim 1 wherein said amine is selected from the group consisting of $C_{14}$–$C_{15}$ secondary alkyl primary amine; $C_{10}$–$C_{14}$ secondary alkyl, primary amine; $C_{15}$–$C_{20}$ secondary alkyl, primary amine; $C_7$–$C_9$ secondary alkyl primary amine; secondary octyl, primary amine; secondary decyl, primary amine; secondary nonyl, primary amine; secondary octadecyl, primary amine; $C_{12}$ tert. alkyl, primary amine; $C_{18}$ tert. alkyl primary amine; $C_{12}$–$C_{14}$ tert. alkyl primary amine; $C_{18}$–$C_{22}$ tert. alkyl primary amine; and $C_{11}$–$C_{14}$ secondary alkyl primary amine.

5. The cylinder lubricant composition of claim 1 wherein said adduct is selected from the group consisting of:

N,N′-di-$C_{14}$–$C_{15}$ secondary alkyl asparagine,
N,N′di-$C_{10}$–$C_{14}$ secondary alkyl asparagine,
N,N′di-$C_{15}$–$C_{20}$ secondary alkyl asparagine,
N,N′di-$C_7$–$C_9$ secondary alkyl asparagine,
N,N′di-$C_{11}$–$C_{14}$ secondary alkyl asparagine,
N,N′di-$C_{12}$-tertiary alkyl asparagine,
N,N′di-$C_{18}$ tertiary alkyl asparagine,
N-sec.-octyl, N′-sec. decyl asparagine,
N-sec-nonyl, N′sec. octadecyl asparagine, and
N-$C_{12}$–$C_{14}$ tertiary alkyl-N′-$C_{18}$–$C_{22}$ tertiary alkyl asparagine.

6. The lubricant composition of claim 1 wherein said amine is selected from the group consisting of $C_{14}$–$C_{15}$ secondary alkyl primary amine; $C_{10}$–$C_{14}$ secondary alkyl, primary amine; $C_{15}$–$C_{20}$ secondary alkyl, primary amine; $C_7$–$C_9$ secondary alkyl primary amine; secondary octyl, primary amine; secondary decyl, primary amine; secondary nonyl, primary amine; secondary octadecyl, primary amine; secondary $C_{12}$ tert. alkyl, primary amine; $C_{18}$ tert. alkyl primary amine; $C_{12}$–$C_{14}$ tert. alkyl primary amine; $C_{18}$–$C_{22}$ tert. alkyl primary amine; and $C_{11}$–$C_{14}$ secondary alkyl primary amine.

7. The cylinder lubricant composition of claim 1 wherein said adduct is selected from the group consisting of:

N,N′di-$C_{14}$–$C_{15}$ secondary alkyl asparagine,
N,N′di-$C_{10}$–$C_{14}$ secondary alkyl asparagine,
N,N′di-$C_{15}$–$C_{20}$ secondary alkyl asparagine,
N,N′di-$C_7$–$C_9$ secondary alkyl asparagine,
N,N′di-$C_{11}$–$C_{14}$ secondary alkyl asparagine,
N,N′di-$C_{12}$ tertiary alkyl asparagine,
N,N′di-$C_{18}$ tertiary alkyl asparagine,
N-sec.-octyl, N′-sec. decyl asparagine,
N-sec.-nonyl, N′-sec. octadecyl asparagine, and
N-$C_{12}$–$C_{14}$ tertiary alkyl-N′-$C_{18}$–$C_{22}$ tertiary alkyl asparagine.

8. The lubricant composition of claim 1 wherein said amine is selected from the group consisting of $C_{14}$–$C_{15}$ secondary alkyl primary amine; $C_{10}$–$C_{14}$ secondary alkyl, primary amine; $C_{15}$–$C_{20}$ secondary alkyl, primary amine; $C_7$–$C_9$ secondary alkyl primary amine; secondary octyl, primary amine; secondary decyl primary amine; secondary nonyl, primary amine; secondary octadecyl, primary amine; $C_{12}$ tert. alkyl, primary amine; $C_{18}$ tert. alkyl primary amine; $C_{12}$–$C_{14}$ tert. alkyl primary amine; $C_{18}$–$C_{22}$ tert. alkyl primary amine; and $C_{11}$–$C_{14}$ secondary alkyl primary amine.

9. The cylinder lubricant composition of claim 1 wherein said adduct is selected from the group consisting of:

N,N′di-$C_{14}$–$C_{15}$ secondary alkyl asparagine,
N,N′di-$C_{10}$–$C_{14}$ secondary alkyl asparagine,
N,N′di-$C_{15}$–$C_{20}$ secondary alkyl asparagine,
N,N′di-$C_7$–$C_9$ secondary alkyl asparagine,
N,N′di-$C_{11}$–$C_{14}$ secondary alkyl asparagine,
N,N′di-$C_{12}$-tertiary alkyl asparagine,
N,N′di-$C_{18}$ tertiary alkyl asparagine,
N-sec.-octyl,N′-sec. decyl asparagine,
N-sec.-nonyl,N′sec. octadecyl asparagine,
N-$C_{12}$–$C_{14}$ tertiary alkyl-N′-$C_{18}$–$C_{22}$ tertiary alkyl asparagine.

* * * * *